US005969309A

United States Patent [19]

Nishimura et al.

[11] Patent Number: 5,969,309

[45] Date of Patent: Oct. 19, 1999

[54] SWITCH ARRANGEMENT OPERABLE IN BOTH SLIDE AND PUSH DIRECTIONS AND ITS ASSEMBLING METHOD

[75] Inventors: Kenji Nishimura; Kouji Sakai, both of Katano, Japan

[73] Assignee: Matsushita Electric Industrial Co., Ltd., Osaka, Japan

[21] Appl. No.: 09/109,764

[22] Filed: Jul. 6, 1998

[30] Foreign Application Priority Data

Jul. 16, 1997 [JP] Japan ..... 9-190839

[51] Int. Cl.[6] ..... H01H 15/06

[52] U.S. Cl. ..... 200/16 C; 200/18; 200/537; 200/550

[58] Field of Search ..... 200/537, 547, 200/549, 550, 18, 16 C

[56] References Cited

U.S. PATENT DOCUMENTS 2,725,432 11/1955 Brown ..... 200/16 C
4,319,100 3/1982 Tallody .
4,851,625 7/1989 Liebich .
4,983,788 1/1991 Pardini .
5,051,552 9/1991 Hou et al. .
5,315,079 5/1994 Gierut ..... 200/550 X
5,378,863 1/1995 Sekita .

*Primary Examiner*—Renee S. Luebke
*Attorney, Agent, or Firm*—Louis Woo

[57] ABSTRACT

A boxlike casing has an opening partly formed on a front wall and a plurality of stationary contacts provided on an inner bottom surface. A slider is installed in the casing and slidable in a predetermined slide direction. The slider has a rod guide portion provided at a predetermined portion and spring receive portions provided at left and right ends. A rod is installed in the rod guide portion and slidable in a push direction normal to the slide direction. The rod has an operating lever protruding forward from the opening of the casing and a push portion extending rearward. At least one elastic contact piece is fixed to at least one of lower surfaces of the slider and the rod for electrically connecting or disconnecting the stationary contacts. Two L-shaped springs have proximal portions held by spring holders. The first arms have distal ends supported by spring receive portions and mesial portions received by arm receive portions. The second arms are pressed by the push portion of the rod movable in the push direction.

14 Claims, 14 Drawing Sheets

SWITCH ARRANGEMENT OPERABLE IN BOTH SLIDE AND PUSH DIRECTIONS AND ITS ASSEMBLING METHOD

BACKGROUND OF THE INVENTION

The present invention relates to a switch arrangement operable in both slide and push directions preferably used in various electronic devices, and its assembling method.

Many slide switches and push switches have been conventionally proposed. It is highly desirable that an operating lever of the switch is automatically returned to its original position. To realize this, each switch accommodates a plurality of springs.

However, providing the plurality of springs increases the total number of switch parts. Installing the springs into a switch casing is complicated and time-consuming because the springs easily jump out of the casing during the assembling work. This results in significant increase of manufacturing costs.

SUMMARY OF THE INVENTION

In view of the foregoing, a principal object of the present invention is to provide a multidirectional switch that is small in the number of used springs, easy to install, and inexpensive in costs.

Another object of the present invention is to provide an assembling method for the multidirectional switch.

In order to accomplish the above and other related objects, the present invention provides a multidirectional switch operable in both slide and push, having various aspects which will be described hereinafter.

According to one aspect of the present invention, a boxlike casing has an open top and an opening partly formed on a front wall thereof. A plurality of stationary contacts are provided on an inner bottom surface of the casing. A slider is installed in the casing and slidable in a predetermined slide direction. A rod is installed in a rod guide portion provided at a predetermined portion of the slider and slidable in a push direction normal to the slide direction. The rod has an operating lever protruding forward from the opening of the casing and a push portion extending rearward. At least one elastic contact piece is fixed to at least one of lower surfaces of the slider and the rod for electrically connecting or disconnecting the stationary contacts. Two L-shaped springs have proximal portions held by spring holders and first and second arms. The first arms have distal ends supported by spring receive portions and mesial portions received by arm receive portions. And, the second arms are pressed by the push portion of the rod movable in the push direction.

The spring holders may be stationarily provided at left and right ends in the casing or on a lower surface of the cover. The spring receive portions may be provided at left and right ends of the slider movable in the slide direction. The arm receive portions may be provided at left and right portions of a lower surface of the cover.

Alternatively, the spring holders may be provided at left and right ends of the slider movable in the slide direction. The arm receive portions may be provided at left and right ends of the slider. The spring receive portions may be provided stationarily in the casing independent of the slide movement of the slider.

Preferably, the multidirectional switch further comprises a push member slidably interposed between the rod and the two springs. The push member has a front face abutting the push portion of the rod and spring push portions pushing the second arms of the two springs.

Preferably, the first arms of the two spring have bent portions supported by corresponding spring receive portions of the slider.

Preferably, the plurality of stationary contacts comprises first stationary contacts and second stationary contacts align in parallel with the slide direction. The second stationary contacts align centrally on the inner bottom surface of the casing. The first stationary contacts position closely to the opening of the casing than the second stationary contacts. Furthermore, only one contact piece is exclusively located above the first stationary contacts and fixed to the lower surface of the rod.

Preferably, a protrusion is provided on the rod movable in the push direction and a recess is provided stationarily at a predetermined portion independent of the push movement of the rod, so that the protrusion of the rod can be guided and received by the recess only when the rod is depressed at a position where the protrusion faces the recess. In this case, the protrusion may be provided on a top surface of the rod and the recess may be provided on a front edge of the cover. Alternatively, the protrusion may be provided on a bottom surface of the rod and the recess may be provided on a front wall of the casing. Similarly, the protrusion may be provided on a rear end of the rod and the recess may be provided on a rear wall of the casing.

Preferably, the slider has spring push portions at a rear end thereof for supporting mesial portions of the first arms of the two springs during the slide movement of the slider.

Another aspect of the present invention provides an assembling method for the above-described multidirectional switch, comprising the following steps.

In a first step, a united spring is installed into the casing. The united spring has a connecting portion where the two L-shaped springs are integrally connected at distal ends of the second arms. Then, in a second step, the connecting portion of the united spring is pushed by the rod to separate the united spring into two independent L-shaped springs.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1:
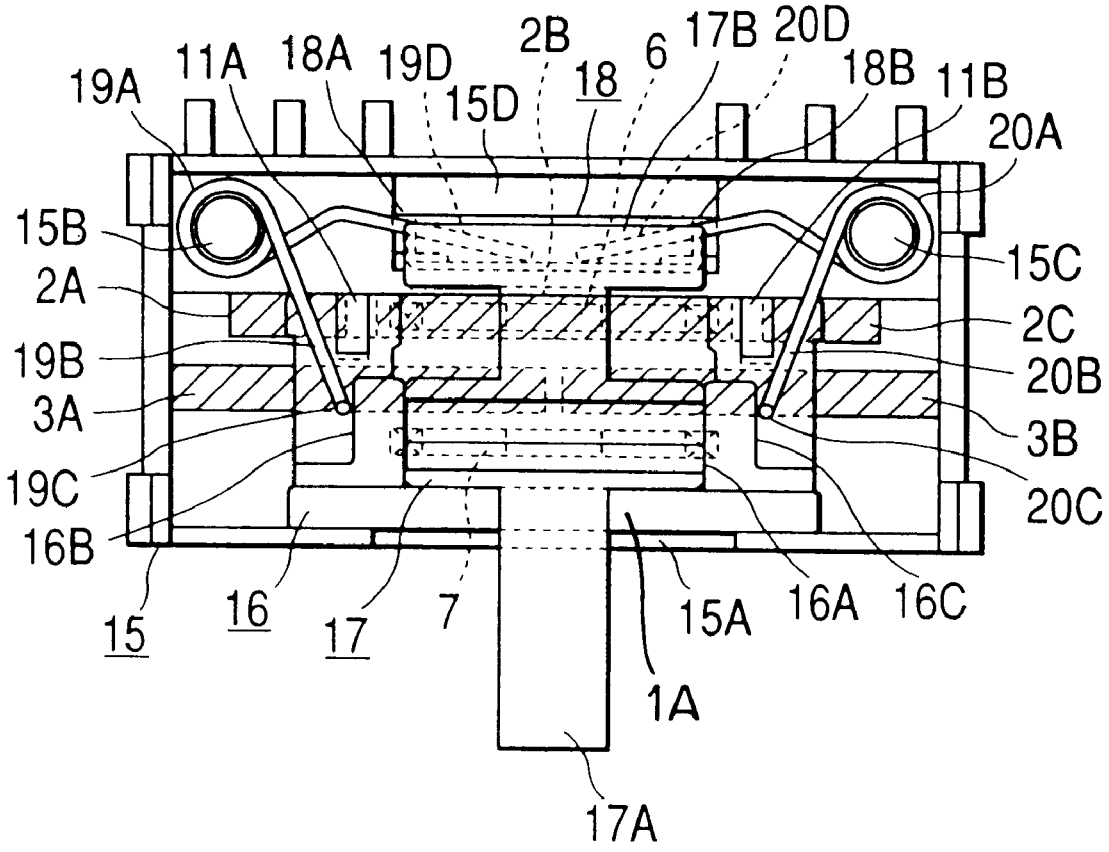
FIG. 1 is a plan view showing a multidirectional switch in accordance with a first embodiment of the present invention.

Preferred embodiments of the present invention will be explained in more detail with reference to FIGS. 1 through 15. Identical parts are denoted by the same reference numerals throughout the drawings.

Figure 15:
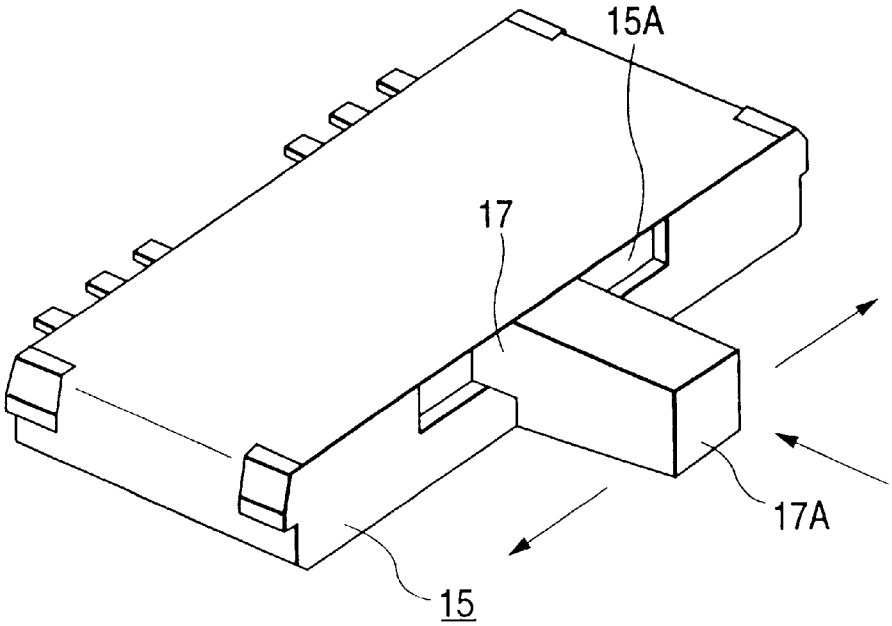
FIG. 15 is a perspective view showing an appearance of the multidirectional switch of the present invention.

FIG. 15 shows a perspective view of a switch operable in both slide and push directions. A boxlike casing 15 has a front wall having an opening 15A through which an operating lever 17A of a rod 17 protrudes forward. The operating lever 17A is operable from its neutral position toward both a slide direction (i.e., right-and-left direction) and a push direction (i.e., back-and-forth direction) that are normal each other. Through these slide and push operations, switch contacts provided in the casing 15 can be electrically connected or disconnected in various ways. When the operating lever 17A is released from an operational force applied thereon, the operating lever 17A returns automatically to the neutral position from the operated position. Thus, this switch functions as a multidirectional switch. Details of this multidirectional switch will be explained with reference to FIGS. 1 to 14B.

First Embodiment

Figure 2:
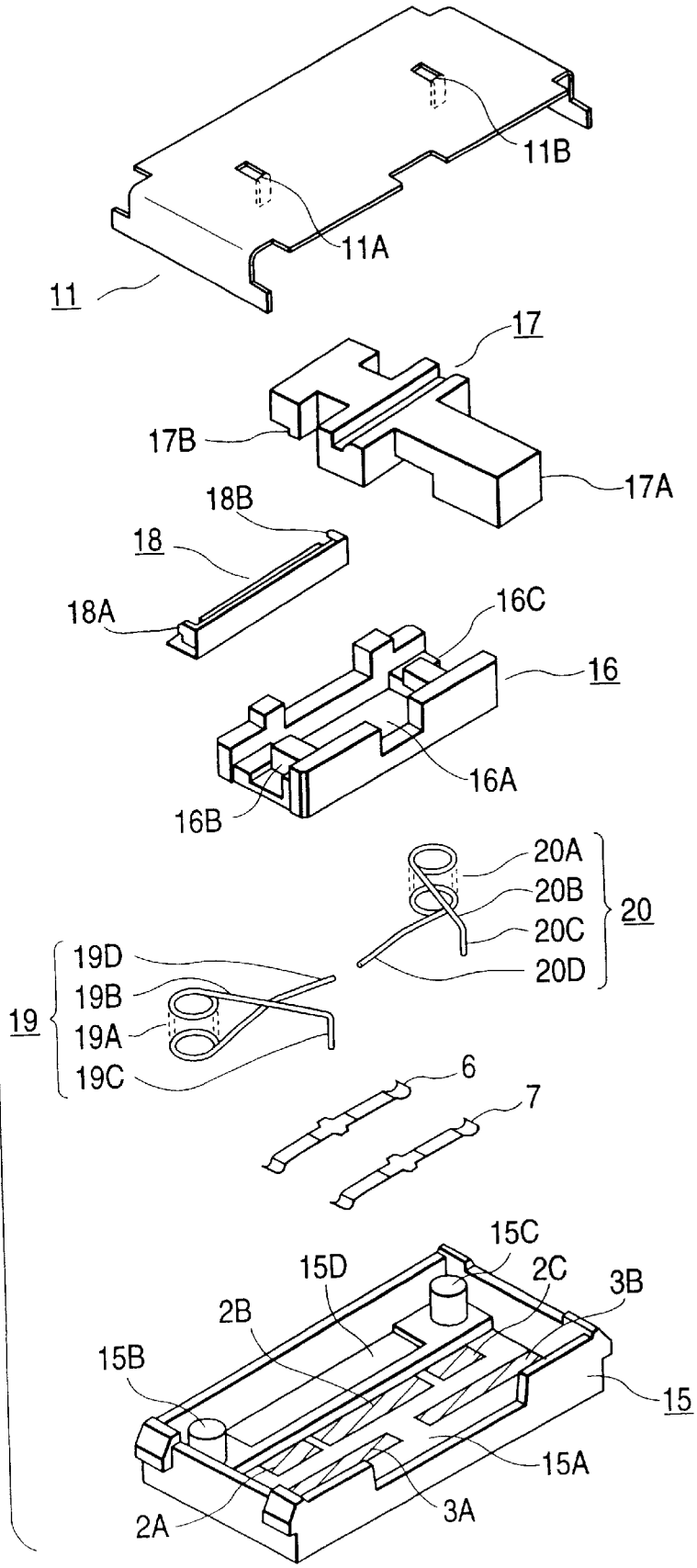
FIG. 2 is an exploded perspective view showing the multidirectional switch in accordance with the first embodiment of the present invention.

FIG. 1 is a plan view showing a multidirectional switch in accordance with a first embodiment. A cover 11 has been removed from the boxlike casing 15. FIG. 2 is an exploded perspective view showing respective parts of the multidirectional switch shown in FIG. 1. The boxlike casing 15, configured in an opened top shape, has the opening 15A provided on a front wall thereof. The casing 15 has a bottom. At substantially the center of the inner bottom surface, a plurality of contacts serving as first stationary contacts 2A, 2B and 2C align in the slide direction. Other contacts, serving as second stationary contacts 3A and 3B, align in parallel to the first stationary contacts 2A, 2B and 2C as well as the opening 1A. The second stationary contacts 3A and 3B are positioned closer to the opening 1A than the first stationary contacts 2A, 2B and 2C. A slider 16, is slidably installed in the casing 15. A rod 17, has an operating lever 17A protruding forward from the opening 15A of the casing 15. The rod 17 is slidable in a rod guide recess 16A formed on the upper surface of the slider 16. The rod 17 can move in both the slide direction and the push direction. The rod 17 has a rear end portion serving as a push portion 17B.

Two cylindrical spring holders 15B and 15C are positioned at the right and left ends on the inner bottom surface of the casing 15, respectively. A guide groove 15D interposes between the spring holders 15B and 15C. A push member 18 is positioned in the guide groove 15D. The push member 18 has a front face abutting the push portion 17B of the rod 17. The push member 18 is slidable in the push direction along the bottom surface of the guide groove 15D.

Furthermore, substantially L-shaped springs 19 and 20 have proximal portions 19A and 20A held by the spring holders 15B and 15C of the casing 15, respectively. The springs 19 and 20 have first arms 19B and 20B, respectively. The first arms 19B and 20B have bent portions 19C and 20C at the distal ends thereof. Spring receive portions 16B and 16C, provided at the left and right sides of the slider 16, support the bent portions 19C and 20C, respectively. Left and right arm receive portions 11A and 11B, formed on the lower surface of the cover 11, support the mesial portions of the first arms 19B and 20B, respectively. Spring push portions 18A and 18B, formed at left and right rear ends of the push member 18, support the second arms 19D and 20D, respectively.

A first contact piece 6 is an elastic metal plate fixed to the lower surface of the slider 16. The first contact piece 6 is brought into contact with the first stationary contacts 2A, 2B and 2C. A second contact piece 7 is an elastic metal plate fixed to the lower surface of the rod 17. The second contact piece 7 is brought into contact with the second stationary contacts 3A and 3B.

Figure 3A:
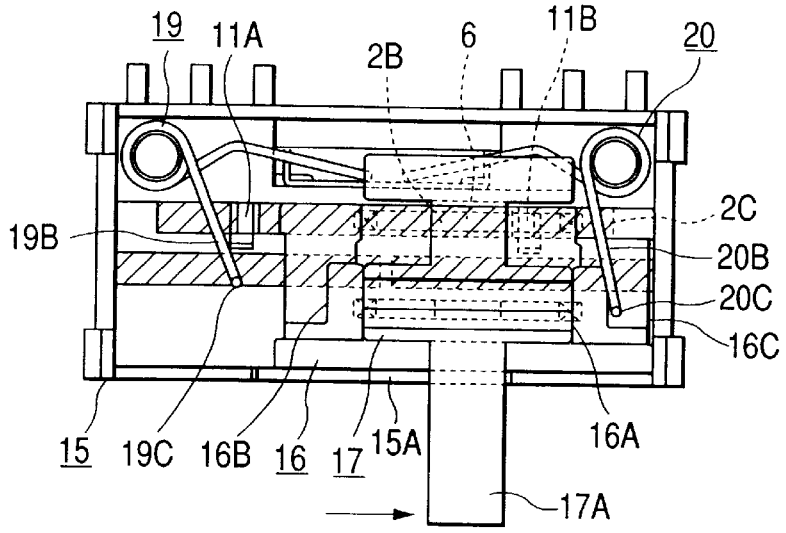
FIG. 3A is a plan view of a first embodiment showing the operating lever of the multidirectional switch being pushed rightward.

According to the above-described arrangement, the operating lever 17A of the rod 17 protrudes forward from the opening 15A of the casing 15. When a user moves the operating lever 17A rightward from the neutral position shown in FIG. 1, the slider 16 slides rightward together with the rod 17 accommodated in the rod guide recess 16A as shown in FIG. 3A. The first contact piece 6, fixed to the lower surface of the slider 16, resiliently slides on the surfaces of the first stationary contacts. When the slider 16 is in the rightmost position, the first contact piece 6 electrically connects the first stationary contacts 2B and 2C. In accordance with this rightward shift movement of the slider 16, the bent portion 19C of the left spring 19 departs from the spring receive portion 16B of the slider 16. Only the arm receive portion 11A of the cover 11 supports the mesial portion of the first arm 19B of the left spring 19. On the other hand, the mesial portion of the first arm 20B of the right spring 20 departs from the arm receive portion 11B of the cover 11. The spring receive portion 16C pushes the bent portion 20C and resiliently compresses the first arm 20B.

In this case, the right spring 20 stores the elastic restoring force when the first arm 20B is elastically compressed by the spring receive portion 16C of the slider 16. Upon the user releasing the operating lever 17A, the compressed right spring 20 resiliently pushes the slider 16 and the accommodated rod 17 back to the neutral position shown in FIG. 1 by the elastic restoring force stored in the first arm 20B. The first stationary contacts 2B and 2C are electrically disconnected.

On the contrary, the user can also move the operating lever 17A leftward from the neutral position shown in FIG. 1. The slider 16 slides leftward together with the rod 17. In this case, the bent portion 20C of the right spring 20 departs from the spring receive portion 16C of the slider 16. Only the arm receive portion 11B of the cover 11 supports the mesial portion of the first arm 20B of the left spring 19. On the other hand, the mesial portion of the first arm 19B of the left spring 19 departs from the arm receive portion 11A of the cover 11. The spring receive portion 16B pushes the bent portion 19C and resiliently compresses the first arm 19B. When the slider 16 is the leftmost position, the first contact piece 6 electrically connects the first stationary contacts 2A and 2B.

The left spring 19 stores the elastic restoring force when the first arm 19B is elastically compressed by the spring receive portion 16B of the slider 16. Upon the user releasing the operating lever 17A, the compressed left spring 19 resiliently pushes the slider 16 and the rod 17 back to the neutral position shown in FIG. 1 by the elastic restoring force stored in the first arm 19B. The first stationary contacts 2A and 2B are electrically disconnected.

Figure 3B:
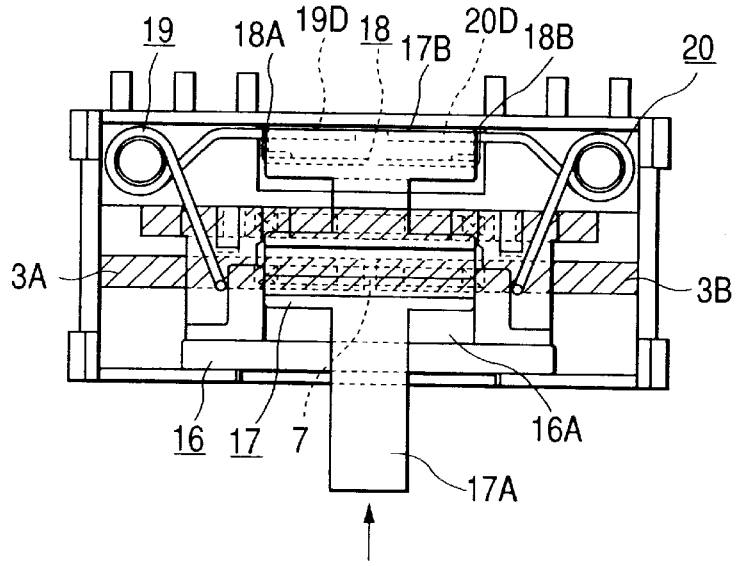
FIG. 3B is a plan view of a first embodiment showing the operating lever of the multidirectional switch being pushed in a direction normal to the casing of the switch.

Furthermore, the user can depress the operating lever 17A in the push direction normal to the slide direction from the neutral position shown in FIG. 1. As shown in FIG. 3B, the push portion 17B formed at the rear end of the rod 17 pushes the front face of the push member 18. The spring push portions 18A and 18B compress the distal ends of the second arms 19D and 20D of the left and right springs 19 and 20, respectively. The rod 17 slides rearward in the rod guide recess 16A. The second contact piece 7, fixed to the lower surface of the slider 17, electrically connects the second stationary contacts 3A and 3B. The left and right springs 19 and 20 store the elastic restoring forces when their second arms 19D and 20D are elastically compressed by the spring push portions 18A and 18B, respectively.

Upon the user releasing the operating lever 17A, the compressed springs 19 and 20 resiliently push the rod 17 back to the neutral position shown in FIG. 1 by the elastic restoring forces stored in the second arms 19D and 20D.

Figure 3C:
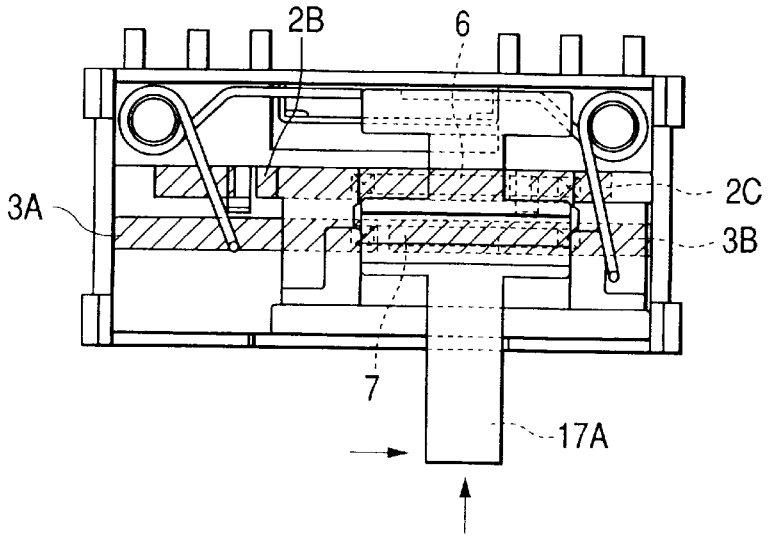
FIG. 3*c* is a plan view of a first embodiment showing the operating lever of the multidirectional switch being operated in both a rightward direction and a direction normal to the casing of the switch.

Regarding the manipulation of the operating lever 17A, it is possible to depress the operating lever 17A from the position shown in FIG. 3A in the push direction. In this case, the slider 16 positions the rightmost position to electrically connect the first stationary contacts 2B and 2C via the first contact piece 6. The second contact piece 7 electrically connects the second stationary contacts 3A and 3B, as shown in FIG. 3C.

According to the above-described first embodiment, the L-shaped springs 19 and 20 have the proximal portions 19A and 20A held by the spring holders 15B and 15C at the left and right ends on the inner bottom surface of the casing 15, respectively. In the neutral position, the spring receive portions 16B and 16C of the slider 16 support the distal ends of the first arms 19B and 20B, respectively. The arm receive portions 11A and 11B of the cover 11 support the mesial portions of the first arms 19B and 20B, respectively. The spring push portions 18A and 18B of the push member 18 support the second arms 19D and 20D, respectively. These two springs 19 and 20 cooperatively act to automatically return the operating lever to the neutral portion. According to this arrangement, the total number of the used springs can be minimized to two. In the assembling of the switch, the springs 19 and 20 are slightly compressed and installed in the casing 15 accommodating the slider 16. This installation can be easily done from the top of the casing 15. The simplified assembling method reduces the cost of the multidirectional switch.

Furthermore, the springs 19 and 20 have bent portions 19C and 20C formed at the distal ends of the first arms 19B and 20B, respectively. The spring receive portions 16B and 16C, provided at the left and right ends of the slider 16, support the bent portions 19C and 20C along their entire length, respectively. This arrangement enlarges the contact area between the slider 16 and the springs 19 and 20. During the sliding operation, the slider 16 surely compresses the first arms 19B and 20B of the springs 19 and 20. In the installation of the springs 19 and 20 into the switch casing 15, the bent portions 19C and 20C can be surely supported by the spring receive portions 16B and 16C of the slider 16. This prevents the springs 19 and 20 from jumping out of the slider 16.

Furthermore, to omit the push member 18, it is possible to support the second arms 19D and 20D of the springs 19 and 20 directly by the rear end face of the rod 17. This reduces the total number of the switch parts, simplifies the assembling work and reduces the costs of the switch.

Figure 4:
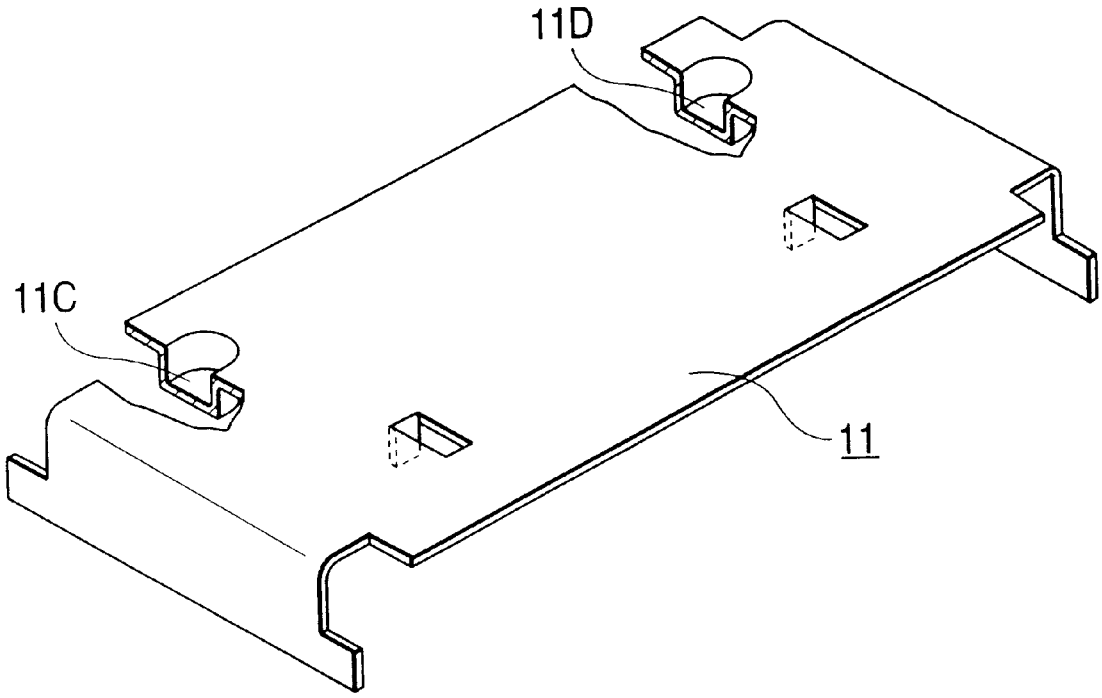
FIG. 4 is a perspective view showing a modified arrangement of the cover used in the multidirectional slide switch in accordance with the first embodiment of the present invention.

According to the above-described embodiment, the cylindrical spring holders 15B and 15C formed on the inner bottom of the casing 15 support the proximal portions 19A and 20A of the L-shaped springs 19 and 20, respectively. However, as shown in FIG. 4, it is possible to form cylindrical spring holders 11C and 11D integral with the cover 11. The spring holders 11C and 11D protrude from the left and right ends of the cover 11 to support the proximate portions 19A and 20A of the springs 19 and 20.

As apparent from the foregoing description, the present invention provides a multidirectional switch operable in both slide and push directions characterized by the following features. A boxlike casing (15) with an open top has an opening (15A) partly formed on a front wall thereof and a plurality of stationary contacts (2A~2C, 3A~3B) provided on an inner bottom surface thereof. A slider (16) is installed in the casing and slidable in a predetermined slide direction. The slider has a rod guide portion (16A) provided at a predetermined portion thereof and spring receive portions (16B, 16C) provided at left and right ends thereof. A rod (17) is installed in the rod guide portion and slidable in a push direction normal to the slide direction. The rod has an operating lever (17A) protruding forward from the opening of the casing and a push portion (17B) extending rearward. At least one elastic contact piece (6 or 7) is fixed to at least one of lower surfaces of the slider and the rod for electrically connecting or disconnecting the stationary contacts. Two L-shaped springs (19, 20) have proximal portions (19A, 20A) held by spring holders (15B, 15C; 11C, 11D) stationarily provided at predetermined left and right portions. The two springs have first arms (19B, 20B) and second arms (19D, 20D). The first arms (19B, 20B) have distal ends supported by the spring receive portions (16B, 16C) of the slider movable in the slide direction and mesial portions received by arm receive portions (11A, 11B) stationarily provided independent of the slide movement of the slider. The second arms (19D, 20D) are pressed by the push portion (17B) of the rod movable in the push direction.

Furthermore, it is preferable that the multidirectional switch of the present invention comprises a push member (18) slidably interposed between the rod and the springs. The push member has a front face abutting the push portion (17B) of the rod and spring push portions (18A, 18B) pushing the second arms of the springs.

Moreover, it is preferable that the first arms of the two springs have bent portions (19C, 20C) supported by corresponding spring receive portions (16B, 16C) of the slider.

Second Embodiment

FIGS. 5A to 5D are plan views showing various operated conditions of the multidirectional switch in accordance with a second embodiment, wherein the cover is removed off the boxlike casing. Like the above-described first embodiment, the casing 15 accommodates the slider 16. The rod 17 is slidable in the rod guide recess 16A of the slider 16. The casing 15 has the cylindrical spring holders 15B and 15C that support the proximal portions 19A and 20A of the springs 19 and 20, respectively. The spring receive portions 16B and 16C of the slider 16 support the distal ends of the first arms 19B and 20B, respectively. The arm receive portions 11A and 11B of the cover 11 support the mesial portions of the first arms 19B and 20B, respectively. The spring push portions 18A and 18B of the push member 18 press the second arms 19D and 20D, respectively. The first stationary contacts 2A, 2B and 2C and the second stationary contacts 3A and 3B align on the inner bottom surface of the casing 15 in parallel to the slide direction of the slider 16.

The second embodiment differs from the first embodiment in that the second stationary contacts 3A and 3B align at substantially the center of the inner bottom surface. The first stationary contacts 2A, 2B and 2C position closely to the opening 15A than the second stationary contacts 3A and 3B. The second contact piece 7, fixed to the lower surface of the rod 17, resiliently contacts with the first stationary contact 2B.

Figure 5C:
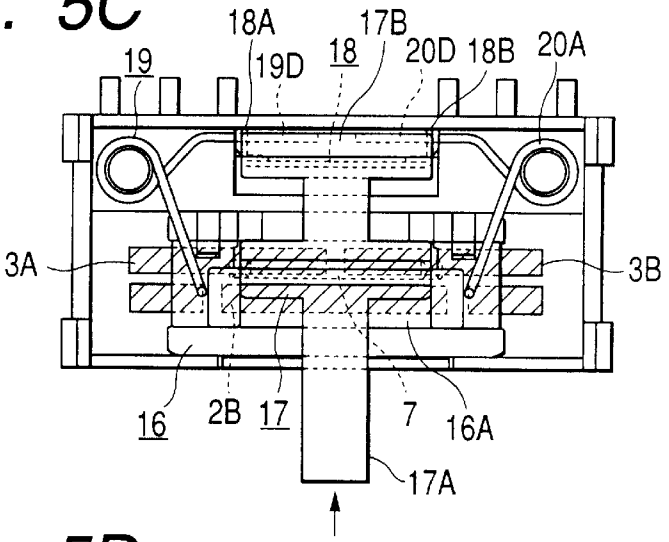
FIG. 5C is a plan view of the second embodiment of the present invention showing the operating lever of the multidirectional switch being pushed in a direction normal to its sliding direction.
Figure 5D:
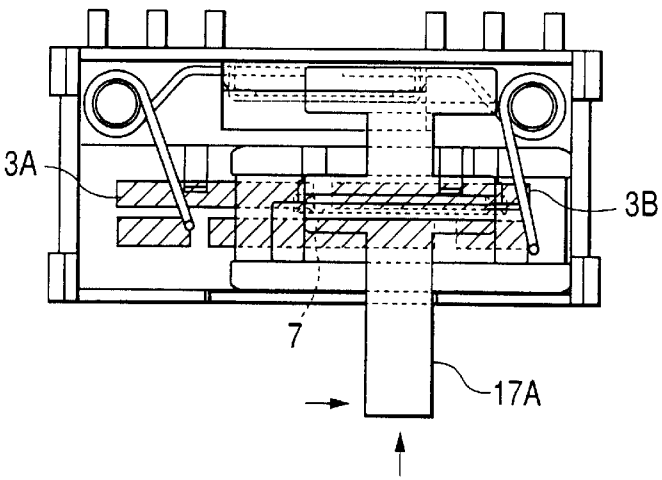
FIG. 5D is a plan view of the second embodiment of the present invention showing the operating lever of the multidirectional switch having been pushed to its rightmost position and is being pushed also in a direction normal to its sliding direction.

According to the arrangement of the second embodiment, the operating lever 17A of the rod 17 protrudes forward from the opening 15A of the casing 15. When the user moves the operating lever 17A rightward from the neutral position shown in FIG. 5A, the slider 16 slides rightward together with the rod 17 accommodated in the rod guide recess 16A as shown in FIG. 5B. The spring receive portion 16C of the slider 16 resiliently compresses the first arm 20B of the right spring 20 in the same manner as explained in the first embodiment. The second contact piece 7, fixed to the lower surface of the rod 17, resiliently slides on the surfaces of the first stationary contacts provided on the inner bottom surface closely to the opening 15A of the casing 15. When the slider 16 is in the rightmost position, the second contact piece 7 electrically connects the first stationary contacts 2B and 2C. Upon the user releasing the operating lever 17A, the compressed right spring 20 resiliently pushes the slider 16 and the accommodated rod 17 back to the neutral position shown in FIG. 5A by the elastic restoring force stored in the first arm 20B.

Figure 5A:
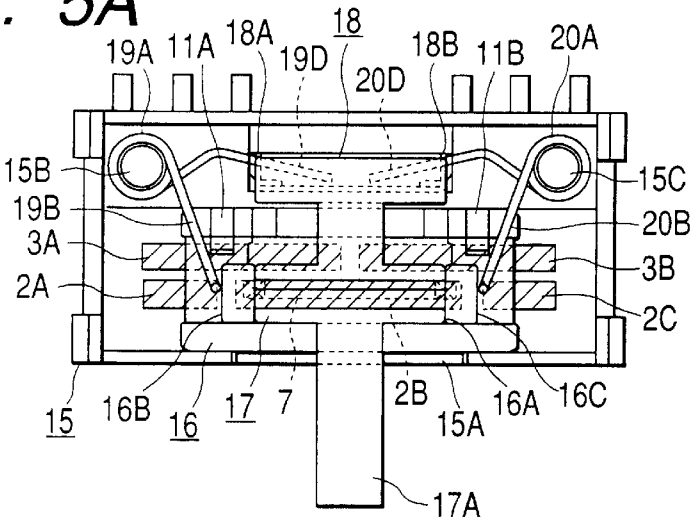
FIG. 5A is a plan view of a second embodiment of the present invention showing the operating lever of the multidirectional switch being positioned in the neutral position.
Figure 5B:
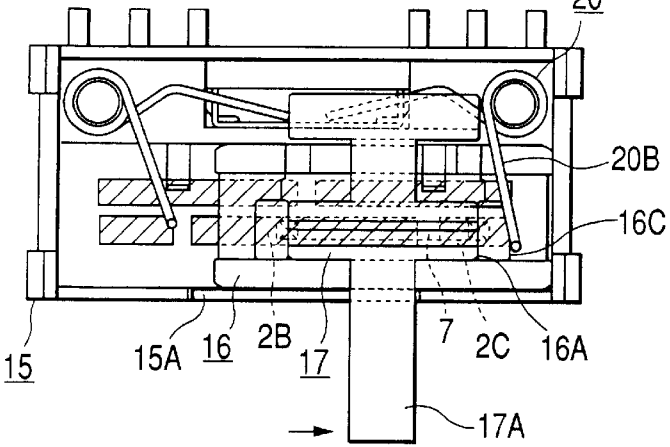
FIG. 5B is a plan view of the second embodiment of the present invention showing the operating lever of the multidirectional switch being slided rightward.

On the contrary, the user can move the operating lever 17A left from the neutral position shown in FIG. 5A. In this case, the spring receive portion 16B of the slider 16 resiliently compresses the first arm 19B of the left spring 19. The second contact piece 7, fixed to the lower surface of the rod 17, electrically connects the first stationary contacts 2A and 2B.

Furthermore, the user can depress the operating lever 17A in the push direction normal to the slide direction from the neutral position shown in FIG. 5A. As shown in FIG. 5C, the push portion 17B of the rod 17 pushes the push member 18 rearward. The spring push portions 18A and 18B compress the second arms 19D and 20D of the springs 19 and 20, respectively. The rod 17 slides rearward in the rod guide recess 16A. The second contact piece 7, fixed to the lower surface of the rod 17, slides rearward along the inner bottom surface of the casing 15. The second contact piece 7 leaves the first stationary contact 2B. When the rod 17 reaches the rearmost position, the second contact piece 7 electrically connects the second stationary contacts 3A and 3B. Upon the user releasing the operating lever 17A, the compressed springs 19 and 20 resiliently push the rod 17 back to the neutral position shown in FIG. 5A by the elastic restoring forces stored in the second arms 19D and 20D.

Like the first embodiment, it is possible to depress the operating lever 17A in the back-and-forth direction from the position shown in FIG. 5B where the slider 16 is positioned at the the rightmost position. When the rod 17 reaches the rearmost position, the second contact piece 7 electrically connects the second stationary contacts 3A and 3B, as shown in FIG. 5D.

According to the above-described second embodiment, the first stationary contacts 2A~2C and the second stationary contacts 3A~3B are aligned on the inner bottom surface of the casing 15 in parallel to the slide direction of the slider 16. The second stationary contacts 3A and 3B are aligned at substantially the center of the inner bottom surface. The first stationary contacts 2A, 2B and 2C are positioned closer to the opening 15A than the second stationary contacts 3A and 3B. No contact piece is fixed to the slider 16. Only one contact piece (i.e., the second contact piece 7 fixed to the lower surface of the rod 17) is used to electrically connect or disconnect the first stationary contacts 2A, 2B and 2C and the second stationary contacts 3A and 3B. In other words, the second embodiment makes it possible to reduce the number of switch parts for realizing the multidirectional switching of a plurality of stationary contacts and simplifying the switch arrangement. Furthermore, the contact piece tends to be easily deformed during the assembling work. In this respect, the second embodiment can facilitate the assembling work of the switch because of the only one required contact piece.

As apparent from the foregoing description, the present invention provides the multidirectional switch, wherein the plurality of stationary contacts comprises first stationary contacts (2A~2C) and second stationary contacts (3A~3B) aligned in parallel with the slide direction. The second stationary contacts is aligned centrally on the inner bottom surface of the casing. The first stationary contacts position closely to the opening (15A) of the casing than the second stationary contacts. Only one contact piece (7) is exclusively located above the first stationary contacts (2A~2C) and fixed to the lower surface of the rod (17).

Third Embodiment

Figure 6:
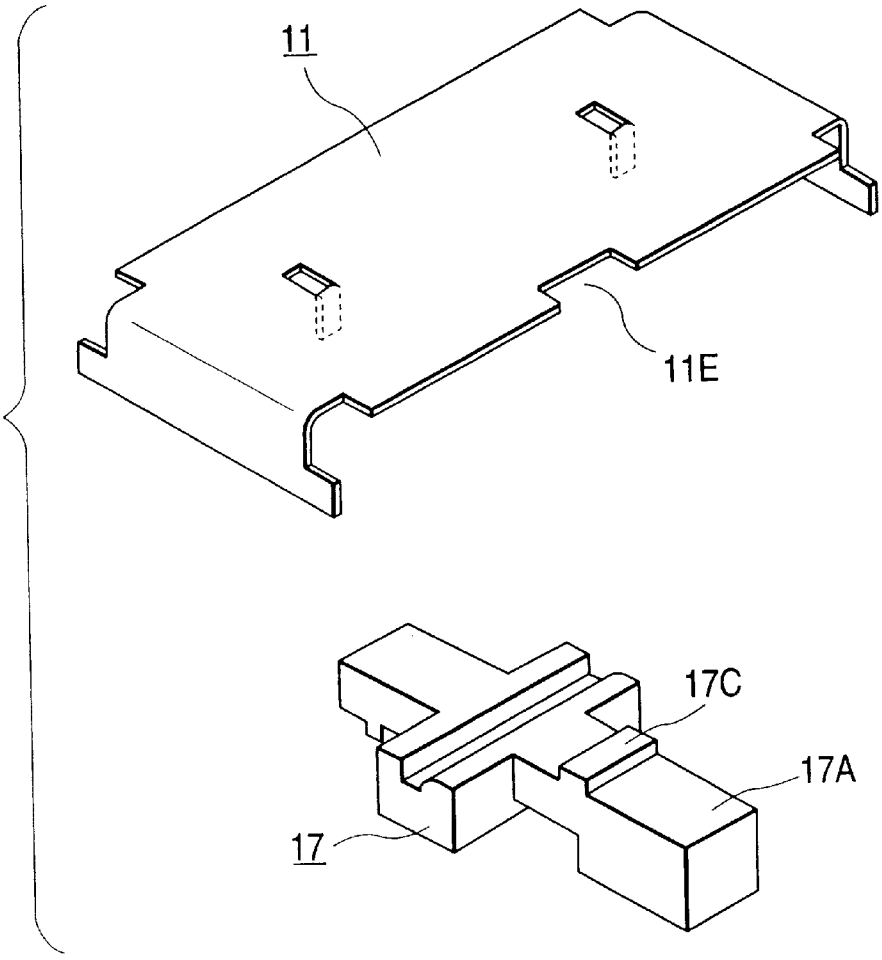
FIG. 6 is a perspective view showing a push mechanism of a multidirectional switch in accordance with a third embodiment of the present invention.

FIG. 6 is a perspective view showing the cover 11 and the rod 17 used in the multidirectional switch in accordance with a third embodiment of the present invention. The rod 17 has the operating lever 17A. The operating lever 17A has a protrusion 17C integrally formed at the top thereof. The cover 11 has a cutout 11E at substantially the center of the front edge thereof. The cutout 11E is slightly wider than the protrusion 17C.

The cover 11 and the rod 17 are assembled in the switch casing 15. The operating lever 17A of the rod 17 protrudes forward from the opening 15A of the casing 15. When the user slides the operating lever 17A, the rod 17 shifts rightward or leftward from the neutral position in the same manner as described in the first and second embodiments. Furthermore, the user can push the operating lever 17A in the push direction (i.e., back-and-forth direction) normal to the slide direction. When the rod 17 is depressed from the neutral position, the protrusion 17C of the rod 17 is guided into the cutout 11E of the cover 11. Thus, the pushing operation is feasible only in the neutral position where the protrusion 17C faces the cutout 11E. However, the front edge of the cover 11 other than the cutout 11E blocks the protrusion 17C when the rod 17 is depressed in the back-and-forth direction from a right or left position offset from the neutral position. Thus, the pushing operation is unfeasible.

Figure 7:
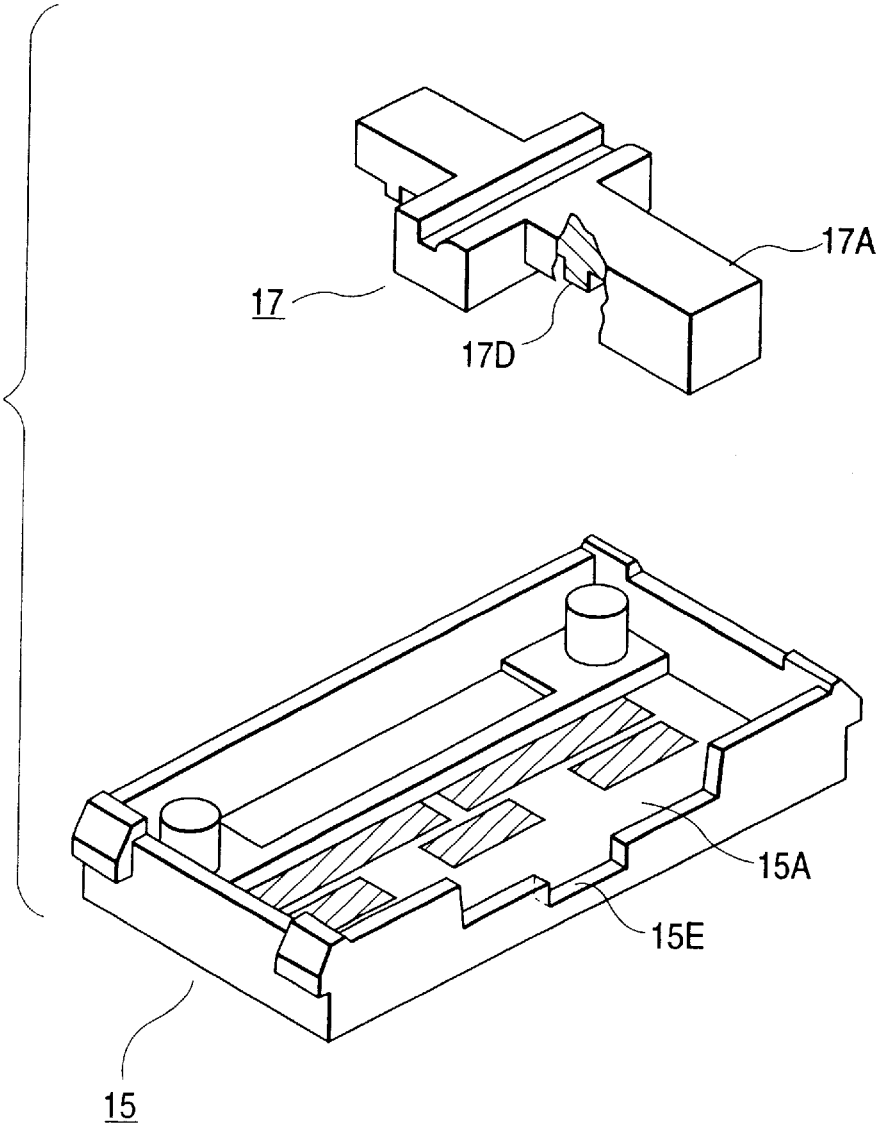
FIG. 7 is a perspective view showing a modified push mechanism of the multidirectional switch in accordance with the third embodiment of the present invention.
Figure 8:
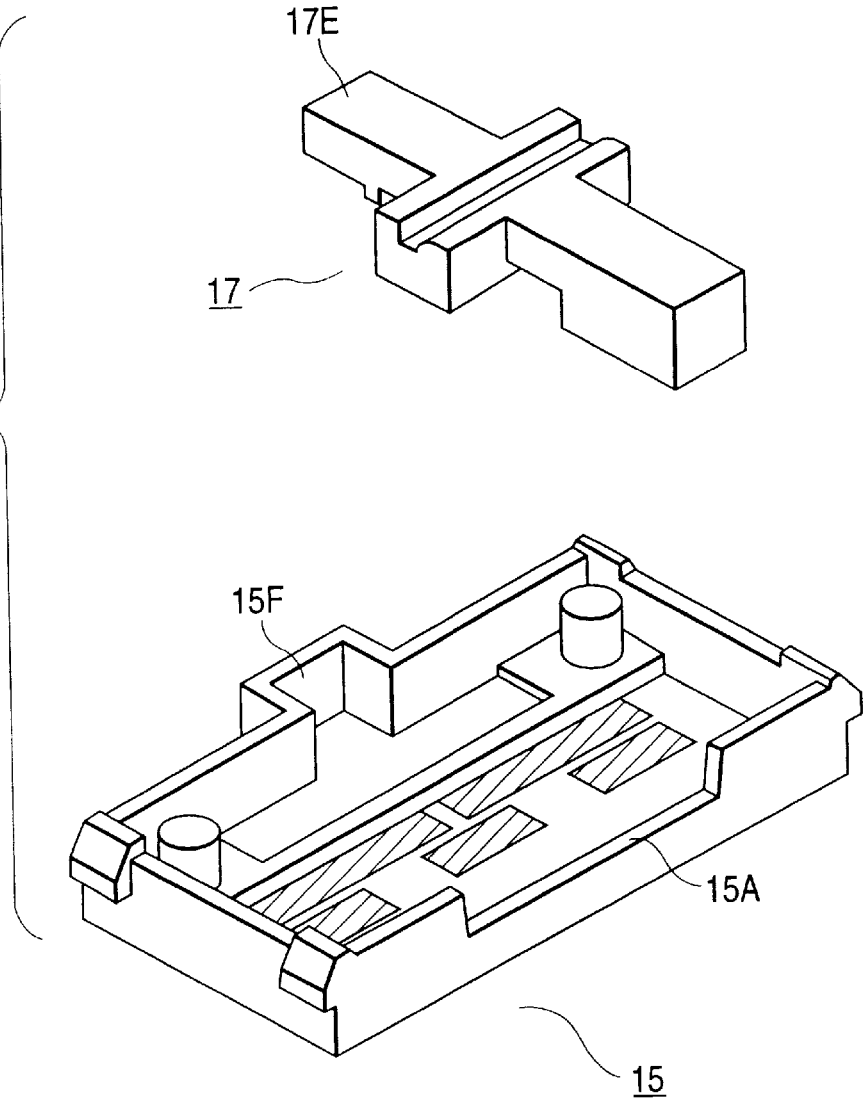
FIG. 8 is a perspective view showing another modified push mechanism of the multidirectional switch in accordance with the third embodiment of the present invention.

FIGS. 7 and 8 are perspective views showing modified arrangement of the rod 17 and the casing 15 in accordance with the third embodiment of the present invention. According to the arrangement of FIG. 7, the operating lever 17A of the rod 17 has a protrusion 17D integrally formed at the bottom thereof. The opening 15A of the cover 11 has a cutout 15E at substantially the center thereof. According to the arrangement of FIG. 8, the operating lever 17A of the rod 17 has a protrusion 17E integrally formed at the rear end thereof. A recess 15F is provided at a rear end wall of the casing 15 opposing the opening 15A. In both arrangements, the pushing operation is feasible only when the rod 17 is in the neutral position. In this respect, the modified arrangements shown in FIGS. 7 and 8 function in the same manner as the arrangement shown in FIG. 6.

According to the above-described explanation, the rod 17 has the protrusion 17C, 17D or 17E at an appropriate portion thereof. The cover 11 or the casing 15 has the cutout 11E or 15E or the recess 15F engageable with the protrusion 17C, 17D or 17E at the center thereof. The pushing operation is feasible only when the rod 17 is in the neutral position. However, it is possible to provide the cutout 11E or 15E or the recess 15F at an arbitrary portion so that the pushing operation is feasible at any intended position other than the neutral position.

As apparent from the foregoing description, the third embodiment provides the rod 17 with the protrusion 17C, 17D or 17E. The cover 11 or the casing 15 has the cutout 11E, 15E or the recess 15F at the predetermined position. The pushing movement of the rod 17 is feasible only when the protrusion 17C, 17D or 17E of the rod 17 engages with and are guided into the corresponding cutout 11E, 15E or recess 15F. Otherwise, the cover 11 or the casing 15 blocks the pushing movement of the rod 17. Thus, the third embodiment makes it possible to arbitrarily select the pushing position of the rod 17 according to the used conditions of the switch. Furthermore, the third embodiment surely prevents the rod 17 from being erroneously pushed during the slide operation.

As apparent from the foregoing description, the present invention provides the multidirectional switch, wherein a protrusion (17C, 17D, 17E) is provided on the rod movable in the push direction and a recess (11E, 15E, 15F) is provided stationarily at a predetermined portion independent of the push movement of the rod, so that the protrusion of the rod can be guided and received by the recess only when the rod is depressed at a position where the protrusion faces the recess.

Fourth Embodiment

Figure 9:
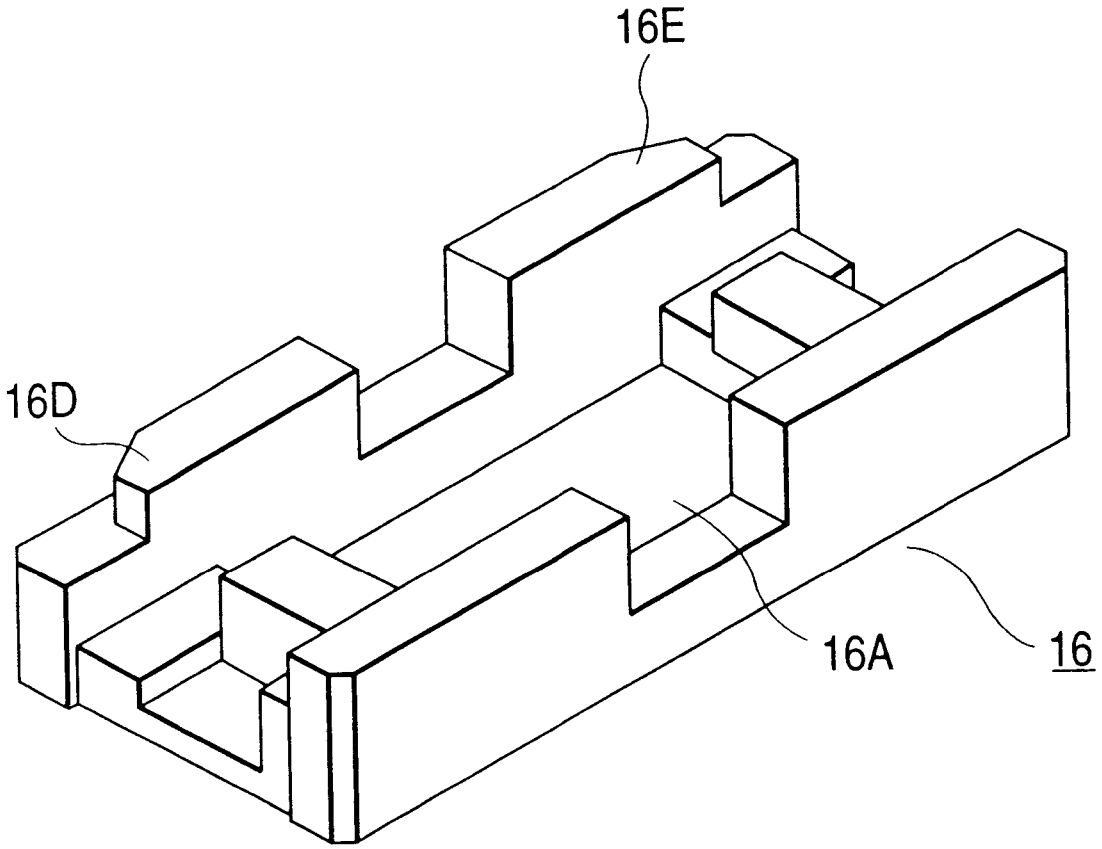
FIG. 9 is a perspective view showing a detailed arrangement of a slider used in a multidirectional switch in accordance with a fourth embodiment of the present invention.
Figure 10C:
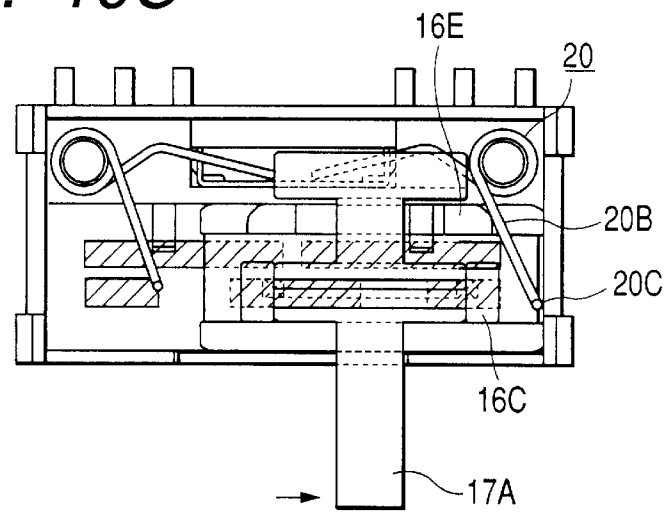
FIG. 10C is a plan view of a fourth embodiment of the present invention showing the operating lever of the multidirectional switching having been pushed to the rightmost position.
Figure 10A:
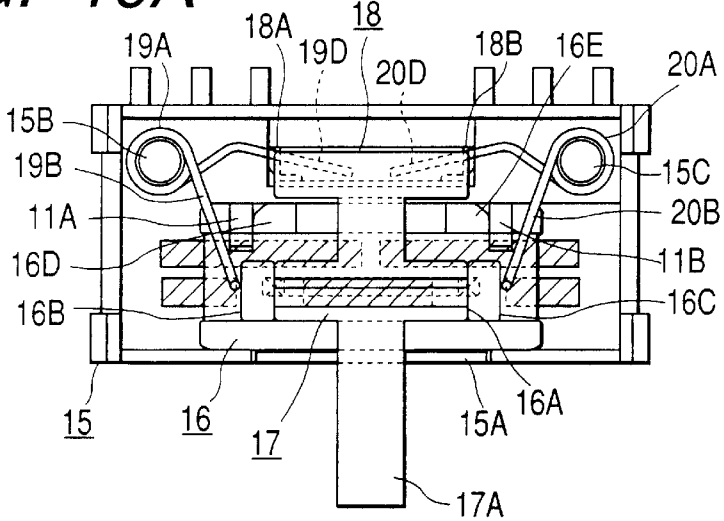
FIG. 10A is a plan view of a fourth embodiment of the instant invention showing the operating lever of the multidirectional switch being at the neutral position.
Figure 10B:
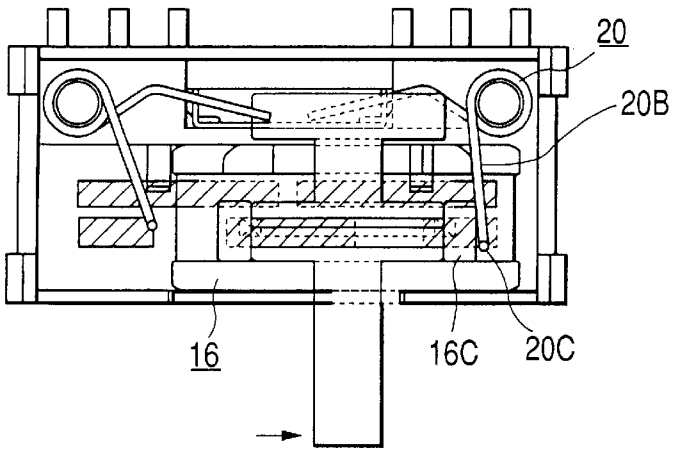
FIG. 10B is a plan view of a fourth embodiment of the present invention showing the operating lever being pushed toward the right of the multidirectional switch.

FIG. 9 is a perspective view showing the slider 16 used in the multidirectional switch in accordance with a fourth embodiment of the present invention. FIGS. 10A to 10C are plan views showing various operated conditions of the multidirectional switch with the cover removed. Like the first and second embodiments, the slider 16 is slidably accommodated in the casing 15. The rod 17 is slidable in the rod guide recess 16A of the slider 16. The left and right L-shaped springs 19 and 20 have the proximal portions 19A and 20A held by the spring holders 15B an 15C of the casing 15, respectively. The spring receive portions 16B and 16C of the slider 16 support the distal ends of the first arms 19B and 20B of the springs 19 and 20, respectively. The arm receive portions 11A and 11B of the cover 11 support the mesial portions of the first arms 19B and 20B, respectively. The spring push portions 18A and 18B of the push member 18 press the second arms 19D and 20D, respectively.

The fourth embodiment differs from the second embodiment in that the slider 16 has left and right spring push portions 16D and 16E provided at the rear end thereof.

According to the arrangement of the fourth embodiment, the user can move the operating lever 17A rightward from the neutral position shown in FIG. 10A. The spring receive portion 16C pushes the distal end (i.e., the bent portion 20C) of the first arm 20B of the right spring 20 when the slider 16 slides from the neutral position to the condition shown in FIG. 10B. The first arm 20B of the right spring 20 is thus elastically compressed by the spring receive portion 16C. The user can further move the operating lever 17A rightward from the FIG. 10B condition. The bent portion 20C formed at the distal end of the first arm 20B of the right spring 20 departs from the spring receive portion 16C of the slider 16. Instead, the spring push portion 16E formed at the rear end of the slider 16 pushes the mesial portion of the first arm 20B, as shown in FIG. 10C. Thus, the first arm 20B of the right spring 20 is elastically compressed by the spring push portion 16E.

According to this arrangement, an increased operating force is necessary when the operating lever 17A slides rightward from the FIG. 10B condition to the FIG. 10C condition. The increase of the operating force occurs in response to the shift of the acting point of the pushing force acting from the rod 17 to the first arm 20B of the right spring 20. That is, the acting point of the pushing force transfers from the distal end (i.e., the bent portion 20C) to the mesial portion closer to the proximal portion 20A when the rod 17 further pushes the first arm 20B after exceeding the condition shown in FIG. 10B.

Upon the user releasing the operating lever 17A, the slider 16 accommodating the rod 17 returns to the neutral position shown in FIG. 10A by the elastic restoring force stored in the first arm 20B of the right spring 20. The slider 16 shifts from the FIG. 10C condition to the FIG. 10B condition. During this earlier returning movement, the mesial portion of the first arm 20B of the right spring 20 pushes the spring push portion 16E of the slider 16. The slider 16 further shifts from the FIG. 10B condition to the FIG. 10A condition. During this later returning movement, the distal portion (i.e., the bent portion 20C) of the first arm 20B pushes the spring receive portion 16C of the slider 16. Thus, the slider 16 returns the neutral position shown in FIG. 10A by the elastic restoring force of the right spring 20 that is larger in the beginning of the returning motion of the slider.

On the contrary, the user can move the operating lever 17A left from the neutral position shown in FIG. 10A. The spring receive portion 16B of the slider 16 pushes the distal end (i.e., the bent portion 19C) of the first arm 19B of the left spring 19 in the earlier stage of the sliding movement of the slider 16. Then, the spring push portion 16D of the slider 16 pushes the mesial portion of the first arm 19B in the later stage of the sliding movement of the slider 16. Thus, the first arm 19B is elastically compressed by the slider 16.

As apparent from the foregoing description, the fourth embodiment provides the spring push portions 16D and 16E at the rear end of the slider 16. The contact points between the slider 16 and respective first arms 19B and 20B of the left and right springs 19 and 20 are transferred from the distal ends (i.e., the bent portions 19C and 20C) to the mesial portions during the sliding movement of the slider 16. Thus, the fourth embodiment provides the operational feel (i.e., operational load) that varies varying during the sliding operation of the switch.

Fifth Embodiment

Figure 11C:
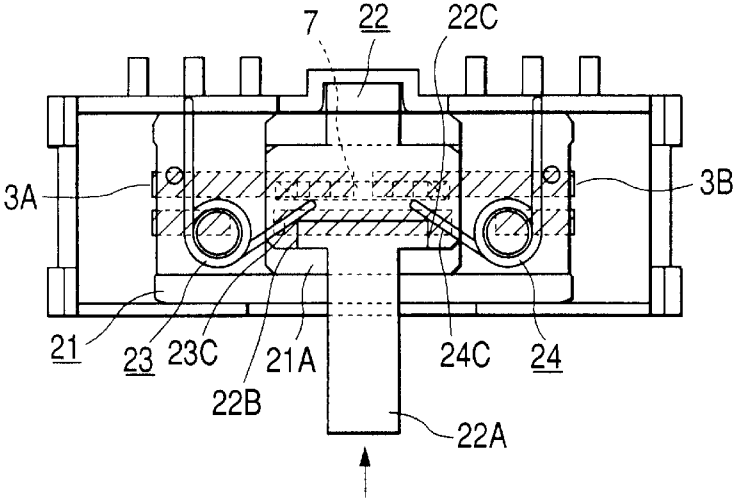
FIG. 11C is a plan view of the fifth embodiment of the present invention showing the operating lever of the fifth embodiment multidirectional switch being pushed in a direction normal to its sliding direction.
Figure 11A:
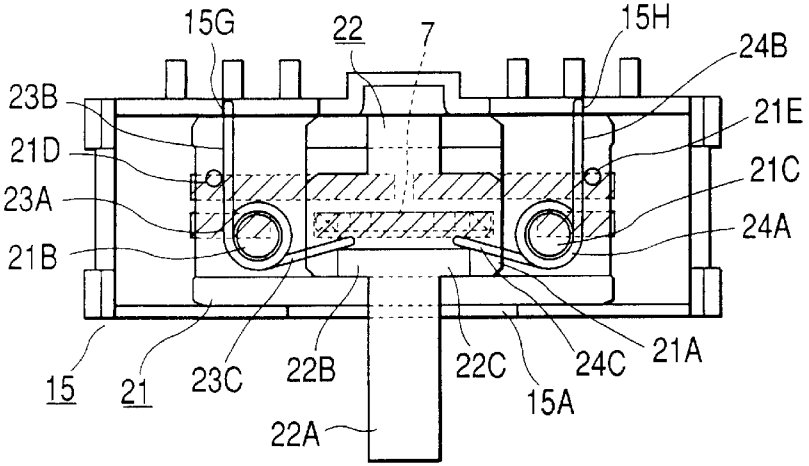
FIG. 11A is a plan view of a fifth embodiment of the present invention showing the operating lever of the multidirectional switch being at its neutral position.
Figure 11B:
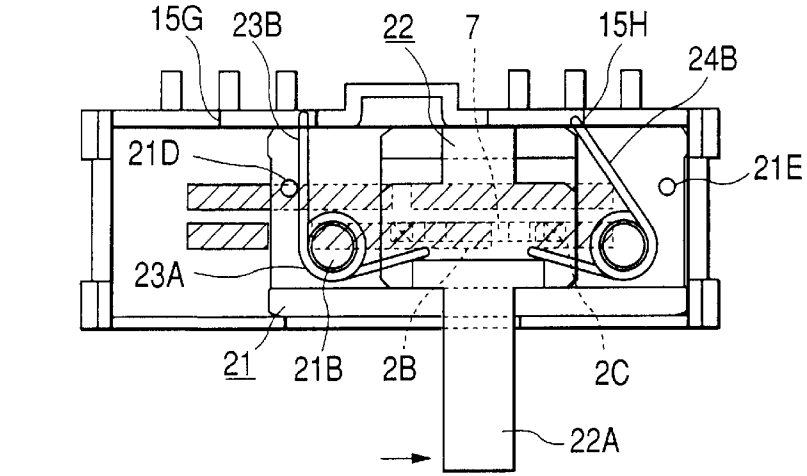
FIG. 11B is a plan view of a fifth embodiment of the present invention showing the operating lever of the multidirectional switch of this embodiment being pushed to its rightmost position.
Figure 12:
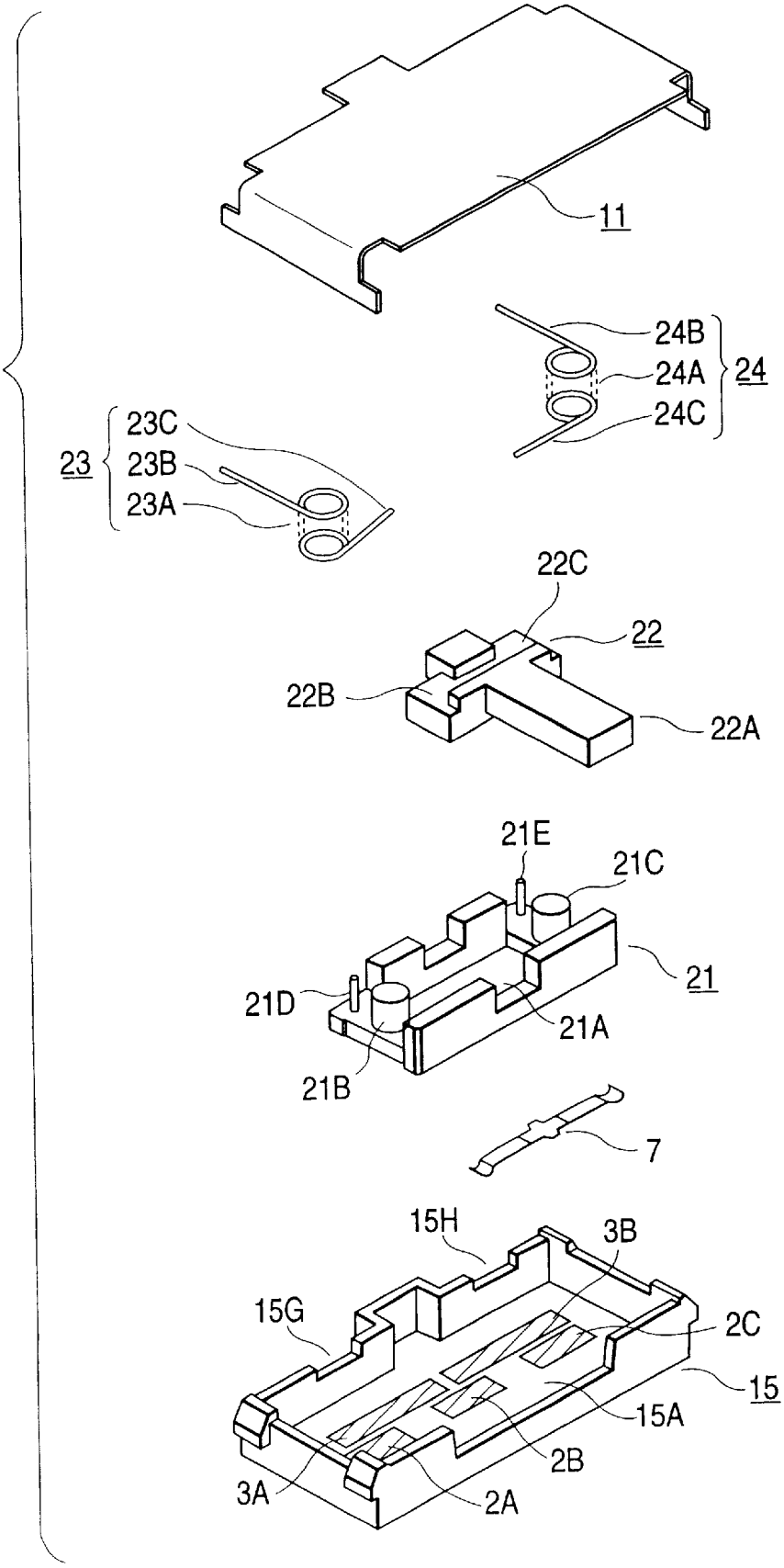
FIG. 12 is an exploded perspective view showing the multidirectional switch in accordance with the fifth embodiment of the present invention.

FIGS. 11A to 11C are plan views showing various operated conditions of a multidirectional switch in accordance with a fifth embodiment of the present invention with the cover removed. FIG. 12 is an exploded perspective view showing the multidirectional switch in accordance with the fifth embodiment. Like the second embodiment, a slider 21 is slidably installed in the casing 15. The slider 21 has a rod guide recess 21A in which a rod 22 is slidable in the push direction. The rod 22 has an operating lever 22A. The second contact piece 7 is fixed to the lower surface of the rod 22. The fifth embodiment differs from the second embodiment in that substantially L-shaped springs 23 and 24 have proximal portions 23A and 24A held by cylindrical spring holders 21B and 21C integrally formed at left and right ends on the slider 21.

Spring receive portions (recesses) 15G and 15H, formed at the rear end wall of the casing 15, support the distal ends of first arms 23B and 24B of the springs 23 and 24, respectively. Arm receive portions 21D and 21E, integrally formed at the left and right ends of the slider 21, support the mesial portions of the first arms 23B and 24B of the springs 23 and 24, respectively. Spring push portions 22B and 22C, integrally formed on the rod 22, press second arms 23C and 24C, respectively.

According to the arrangement of the fifth embodiment, the operating lever 22A of the rod 22 protrudes forward from the opening 15A of the casing 15. When the user moves the operating lever 22A rightward from the neutral position shown in FIG. 11A, the second contact piece 7, fixed to the lower surface of the rod 22, resiliently slides on the surfaces of the first stationary contacts. When the slider 21 reaches the rightmost position, the second contact piece 7 electrically connects the first stationary contacts 2B and 2C in the same manner as described in the second embodiment. The distal end of the first arm 23B of the left spring 23 departs from the spring receive portion 15G of the casing 15 in accordance with the rightward shift movement of the slider 21 accommodating the rod 22. The proximal portion 23A of the left spring 23 is held by the spring holder 21B of the holder 21. The arm receive portion 21D supports the mesial portion of the left spring 23. On the other hand, the spring receive portion 15H of the casing 15 supports the distal end of the first arm 24B of the right spring 24. The mesial portion of the first arm 24B departs from the arm receive portion 21E.

Upon the user releasing the operating lever 22A, the compressed right spring 24 resiliently pushes the slider 21 and the accommodated rod 22 back to the neutral position shown in FIG. 11A by the elastic restoring force stored in the first arm 24B of the right spring 24. The second contact piece 7 electrically disconnects the first stationary contacts 2B and 2C. The right spring 24 stores this elastic restoring force when the first arm 24B being supported by the spring receive portion 15H is elastically compressed.

The user can also move the operating lever 22A leftward from the neutral position shown in FIG. 11A. In this case, the distal end of the first arm 24B of the right spring 24 departs from the spring receive portion 15H. The arm receive portion 21E supports the mesial portion of the first arm 24B of the right spring 24. The mesial portion of the first arm 23B of the left spring 23 departs from the arm receive portion 21D of the slider 21. The distal end of the first arm 23B, supported by the spring receive portion 15G, is elastically compressed. When the slider 21 reaches the leftmost position, the contact piece 7 electrically connects the first stationary contacts 2A and 2B.

Upon the user releasing the operating lever 22A, the compressed left spring 23 resiliently pushes the slider 21 and the accommodated rod 22 back to the neutral position shown in FIG. 11A by the elastic restoring force stored in the first arm 23B, of the left spring 23. The left spring 23 stores this elastic restoring force when the first arm 23B being supported by the spring receive portion 15G, is elastically compressed.

Furthermore, the user can depress the operating lever 22A in the push direction (i.e., back-and-forth direction) from the neutral position shown in FIG. 11A. As shown in FIG. 11C, spring push portions 22B and 22C of the rod 22 compress the distal ends of the second arms 23C and 24C of the left and right springs 23 and 24, respectively. The rod 22 slides rearward in the rod guide recess 21A, while the second arms 23C and 24C are elastically compressed. The second contact piece 7, fixed to the lower surface of the slider rod 22, electrically connects the second stationary contacts 3A and 3B. Upon the user releasing the operating lever 22A, the compressed springs 23 and 24 resiliently push the rod 22 back to the neutral position shown in FIG. 11A by the elastic restoring forces stored in the second arms 23C and 24C.

According to the above-described fifth embodiment, the proximal portions 23A and 24A of the L-shaped springs 23 and 24 are held by the spring holders 21B and 21C of the slider 21, respectively. The casing 15 has no spring holders at the left and right ends thereof. This reduces the back-and-forth size of the switch as well as downsizes the switch. The springs 23 and 24 can be assembled, as a unit component, on the upper surface of the slider 21. This unit can be easily installed in the casing 15 while the spring receive portions 15G and 15H support the first arms 23B and 24B of the springs 23 and 24, respectively. This facilitates the assembling work of the two springs 23 and 24 and the slider 21 into the casing 15. As a result, the switch assembling work can be simplified.

As apparent from the foregoing description, the present invention provides a multidirectional switch operable in both slide and push directions characterized by the following features. A boxlike casing (15) with an open top, has an opening (15A) partly formed on a front wall thereof and a plurality of stationary contacts (2A~2C, 3A~3B) provided on an inner bottom surface thereof. A slider (2) is installed in the casing and slidable in a predetermined slide direction. The slider has a rod guide portion (21A) provided at a predetermined portion thereof and spring holders (21B, 21C) and arm receive portions (21D, 21E) provided at left and right ends thereof. A rod (22) is installed in the rod guide portion and slidable in a push direction normal to the slide direction. The rod has an operating lever (22A) protruding forward from the opening of the casing and a push portion (22B, 22C) extending rearward. At least one elastic contact piece (7) is fixed to at least one of lower surfaces of the slider and the rod for electrically connecting or disconnecting the stationary contacts. Two L-shaped springs (23, 24) have proximal portions (23A, 24A) held by the spring holders (21B, 21C) of the slider movable in the slide direction. The two springs have first arms (23B, 24B) and second arms (23C, 24C). The first arms (23B, 24B) have distal ends supported by spring receive portions (15G, 15H) stationarily provided at a predetermined portion independent of the slide movement of the slider and mesial portions received by the arm receive portions (21D, 21E) of the slider. And, the second arms (23C, 24C) are pressed by the push portion (22B, 22C) of the rod movable in the push direction.

Sixth Embodiment

Figure 13:
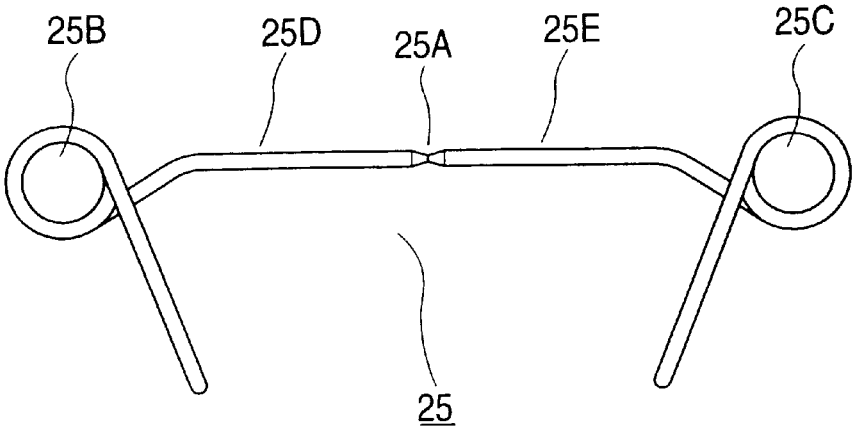
FIG. 13 is a plan view showing a detailed arrangement of a united spring used in the multidirectional switch in accordance with a sixth embodiment of the present invention.
Figure 14A:
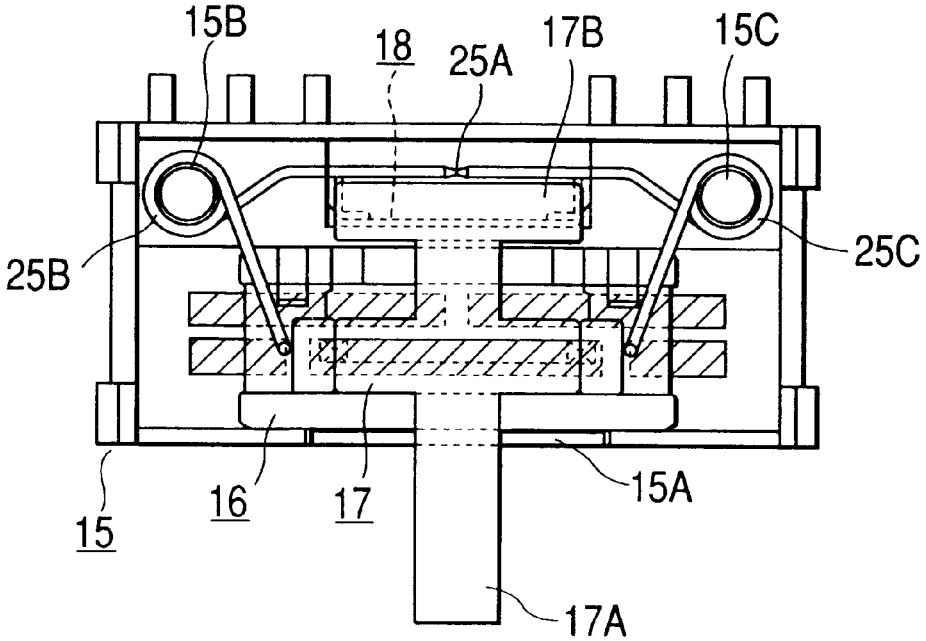
FIG. 14A is a plan view of a multidirectional switch of the present invention showing a single spring with a thinned portion being fitted within the multidirectional switch.
Figure 14B:
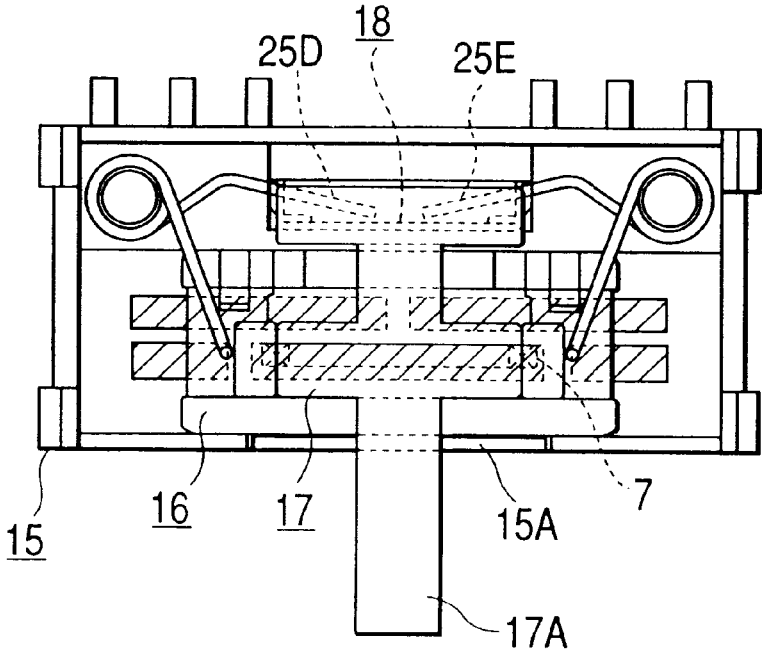
FIG. 14B is a plan view of the same switch of FIG. 14A in which the spring shown in FIG. 14A has been broken into two pieces.

FIG. 13 is a plan view showing a united spring used in the multidirectional switch in accordance with a sixth embodiment of the present invention. FIGS. 14A and 14B are plan views showing an assembling method of the multidirectional switch of the sixth embodiment, with the cover removed. Like the second embodiment, the slider 16 is slidably installed in the casing 15. The rod 17 is accommodated in the slider 16 so as to be slidable in the push direction. The rod 17 has the operating lever 17A. The sixth embodiment differs from the second embodiment in that a spring 25 is a united spring consisting of two L-shaped springs connected at the distal ends of their second arms. The spring 25 has a thinned connecting portion 25A at the connecting point of the two L-shaped springs.

The multidirectional switch of the sixth embodiment is assembled in the following manner. As shown in FIG. 14A, proximal portions 25B and 25C of the spring 25 are held by the spring holders 15B and 15C of the casing 15, respectively. Then, the slider 16 and the rod 17 are assembled in such a manner that the operating lever 17A of the rod 17 protrudes forward from the opening 15A of the casing 15. Subsequently, the operating lever 17A is depressed. The push member 18 abuts the push portion 17B formed at the rear end of the rod 17. Being depressed by the push member 18, the spring 25 is broken at the thinned connecting portion 25A formed at the center thereof and separates into two L-shaped springs. As shown in FIG. 14B, the push member 18 presses the two separated arms 25D and 25E.

According to the arrangement of the sixth embodiment, the user can move the operating lever 17A in both the slide and push directions from the neutral position shown in FIG. 14A. The slider 16 and the push member 18 elastically compress the first arms and the second arms 25D and 25E of the L-shaped springs. The second contact piece 7 electrically connects the stationary contacts in the same manner as described in the second embodiment.

As described above, the sixth embodiment provides the united spring 25 consisting of two arms 25D and 25E connected at the distal ends of their second arms 25D and 25E. After the united spring 25 is installed in the casing 15, the united spring 25 is separated into two independent L-shaped springs by pushing the rod 17. The total number of switch parts can be reduced. The united spring 25 is easy to handle when installed in the casing 15. This facilitates the assembling work of the switch.

As described in the foregoing description, the present invention makes it possible to provide a multidirectional switch with reduced number of the used springs, thereby facilitating the assembling work of the switch and reducing the cost.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A multidirectional switch operable in both slide and push directions comprising:

a boxlike casing with an open top, having an opening partly formed on a front wall thereof and a plurality of stationary contacts provided on an inner bottom surface thereof;

a slider installed in said casing and slidable in a predetermined slide direction;

a rod installed in a rod guide portion provided at a predetermined portion of said slider and slidable in a push direction normal to said slide direction, said rod having an operating lever protruding forward from said opening of said casing and a push portion extending rearward;

at least one elastic contact piece fixed to at least one of lower surfaces of said slider and said rod for electrically connecting or disconnecting said stationary contacts; and two L-shaped springs having proximal portions held by spring holders, first arms having distal ends supported by spring receive portions and mesial portions received by arm receive portions, and second arms being pressed by said push portion of said rod movable in said push direction.

2. The multidirectional switch in accordance with claim 1, wherein said spring holders and said arm receive portions are stationary and said spring receive portions are movable.

3. The multidirectional switch in accordance with claim 1, wherein said spring holders and said arm receive portions are movable and said spring receive portions are stationary.

4. The multidirectional switch in accordance with claim 1, further comprising a push member slidably interposed between said rod and said two springs, said push member having a front face abutting said push portion of said rod and spring push portions pushing said second arms of said two springs.

5. The multidirectional switch in accordance with claim 1, wherein said first arms of said two spring have bent portions supported by corresponding spring receive portions of said slider.

6. The multidirectional switch in accordance with claim 1, wherein said plurality of stationary contacts comprises first stationary contacts and second stationary contacts align in parallel with said slide direction, said second stationary contacts align centrally on said inner bottom surface of the casing, and said first stationary contacts position closely to said opening of said casing than said second stationary contacts, and further only one contact piece is exclusively located above said first stationary contacts and fixed to the lower surface of said rod.

7. The multidirectional switch in accordance with claim 1, wherein a protrusion is provided on said rod movable in said push direction and a recess is provided stationarily at a predetermined portion independent of the push movement of said rod, so that said protrusion of the rod can be guided and received by said recess only when said rod is depressed at a position where said protrusion faces said recess.

8. The multidirectional switch in accordance with claim 7, wherein said protrusion is provided on a top surface of said rod and said recess is provided on a front edge of said cover.

9. The multidirectional switch in accordance with claim 7, wherein said protrusion is provided on a bottom surface of said rod and said recess is provided on a front wall of said casing.

10. The multidirectional switch in accordance with claim 7, wherein said protrusion is provided on a rear end of said rod and said recess is provided on a rear wall of said casing.

11. The multidirectional switch in accordance with claim 1, wherein said slider has spring push portions at a rear end thereof for supporting mesial portions of said first arms of said two springs during the slide movement of said slider.

12. A multidirectional switch operable in both slide and push directions comprising:

a boxlike casing with an open top, having an opening partly formed on a front wall thereof and a plurality of stationary contacts provided on an inner bottom surface thereof;

a slider installed in said casing and slidable in a predetermined slide direction, having a rod guide portion provided at a predetermined portion thereof and spring receive portions provided at left and right ends thereof;

a rod installed in said rod guide portion and slidable in a push direction normal to said slide direction, having an operating lever protruding forward from said opening of said casing and a push portion extending rearward;

at least one elastic contact piece fixed to at least one of lower surfaces of said slider and said rod for electrically connecting or disconnecting said stationary contacts; and two L-shaped springs having proximal portions held by spring holders stationarily provided at predetermined left and right portions, said two springs having first arms and second arms, said first arms having distal ends supported by said spring receive portions of said slider movable in said slide direction and mesial portions received by arm receive portions stationarily provided independent of the slide movement of said slider, and said second arms being pressed by said push portion of said rod movable in said push direction.

13. A multidirectional switch operable in both slide and push directions comprising:

a boxlike casing with an open top, having an opening partly formed on a front wall thereof and a plurality of stationary contacts provided on an inner bottom surface thereof;

a slider installed in said casing and slidable in a predetermined slide direction, having a rod guide portion provided at a predetermined portion thereof as well as spring holders and arm receive portions provided at left and right ends thereof;

a rod installed in said rod guide portion and slidable in a push direction normal to said slide direction, having an operating lever protruding forward from said opening of said casing and a push portion extending rearward;

at least one elastic contact piece fixed to at least one of lower surfaces of said slider and said rod for electrically connecting or disconnecting said stationary contacts; and two L-shaped springs having proximal portions held by said spring holders of said slider movable in said slide direction, said two springs having first arms and second arms, said first arms having distal ends supported by spring receive portions stationarily provided at a predetermined portion independent of the slide movement of said slider and mesial portions received by said arm receive portions of said slider, and said second arms being pressed by said push portion of said rod movable in said push direction.

14. An assembling method for a multidirectional switch, said multidirectional switch comprising:

a boxlike casing with an open top, having an opening partly formed on a front wall thereof and a plurality of stationary contacts provided on an inner bottom surface thereof;

a slider installed in said casing and slidable in a predetermined slide direction;

a rod installed in a rod guide portion provided at a predetermined portion of said slider and slidable in a push direction normal to said slide direction, said rod having an operating lever protruding forward from said opening of said casing and a push portion extending rearward;

at least one elastic contact piece fixed to at least one of lower surfaces of said slider and said rod for electrically connecting or disconnecting said stationary contacts;

two L-shaped springs having proximal portions held by spring holders, first arms having distal ends supported by spring receive portions and mesial portions received by arm receive portions, and second arms being pressed by said push portion of said rod movable in said push direction, and said assembling method comprising the steps of:

installing a united spring into said casing, said united spring having a connecting portion where said two L-shaped springs are integrally connected at distal ends of said second arms; and pushing said connecting portion of said united spring by said rod to separate said united spring into two independent L-shaped springs.

* * * * *